US007281895B2

(12) United States Patent
Liang

(10) Patent No.: US 7,281,895 B2
(45) Date of Patent: Oct. 16, 2007

(54) COOLING SYSTEM FOR A TURBINE VANE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 861 days.

(21) Appl. No.: 10/697,369

(22) Filed: Oct. 30, 2003

(65) Prior Publication Data

US 2005/0095119 A1 May 5, 2005

(51) Int. Cl.
*F01D 5/18* (2006.01)

(52) U.S. Cl. ..... 416/97 R

(58) Field of Classification Search ..... 416/96 A, 416/96 R, 97 R; 415/115
See application file for complete search history.

(56) References Cited

U.S. PATENT DOCUMENTS 3,574,481 A 4/1971 Pyne, Jr.
4,650,399 A 3/1987 Craig et al.
5,271,715 A 12/1993 Zelesky et al.
5,387,086 A 2/1995 Frey et al.
5,403,159 A 4/1995 Green et al.
5,645,397 A 7/1997 Soechting et al.
5,688,104 A 11/1997 Beabout
5,827,043 A 10/1998 Fukuda et al.
5,975,851 A 11/1999 Liang
6,099,251 A 8/2000 LaFleur
6,168,381 B1 1/2001 Reddy
6,206,638 B1 3/2001 Glynn et al.
6,435,813 B1 * 8/2002 Rieck et al. ..... 415/115
6,508,620 B2 * 1/2003 Sreekanth et al. ..... 415/115

* cited by examiner

*Primary Examiner*—Edward K. Look
*Assistant Examiner*—Nathan Wiehe

(57) ABSTRACT

A turbine vane usable in a turbine engine and having at least one cooling system. The cooling system may include at least one convergent flow channel for receiving air from a shroud assembly. The cooling system may also include impingement channels in a leading edge cavity for impinging a cooling fluid against an inner surface of a leading edge of the turbine vane. The cooling system may also include a serpentine cooling path for removing heat from aft sections of the turbine vane proximate to the trailing edge of the turbine vane. The cooling system may also include a divergent leading edge cavity. Exterior film cooling is not needed to safely operate a turbine vane according to this invention.

20 Claims, 3 Drawing Sheets

COOLING SYSTEM FOR A TURBINE VANE

FIELD OF THE INVENTION

This invention is directed generally to turbine vanes, and more particularly to hollow turbine vanes having cooling channels for passing cooling fluids, such as air, to cool the vanes and supply cooling fluids to the manifold of a turbine assembly.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to a manifold. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. A substantially portion of the air is passed into a manifold to which the vane is movable coupled. The air supplied to the manifold may be used, among other uses, to cool turbine blade assemblies coupled to the manifold. While advances have been made in the cooling systems in turbine vanes, a need still exists for a turbine vane having increased cooling efficiency for dissipating heat and passing a sufficient amount of cooling air through the vane and into the manifold.

SUMMARY OF THE INVENTION

This invention relates to a turbine vane having a cooling system including a convergent flow channel for receiving cooling fluids from a shroud assembly and passing a portion of the cooling fluids to one or more impingement channels in a leading edge cooling cavity and allowing the remainder of the cooling fluids to pass through a serpentine cooling path before being exhausted through exhaust orifices in the trailing edge of the turbine vane. The cooling system has the capacity to sufficiently cool the turbine vane without requiring external film cooling orifices.

The turbine vane may be formed from a generally elongated hollow airfoil having a leading edge, a trailing edge, a pressure side, a suction side, a first end adapted to be coupled to a shroud assembly, and a second end opposite the first end adapted to be coupled to a manifold assembly. The convergent flow channel may include an inlet generally at the first end of the airfoil and may extend toward the second end of the airfoil. The convergent flow channel may have a first cross-sectional area proximate to the first end of the airfoil that is larger than a second cross-sectional area of the convergent flow channel closer to the second end of the airfoil than the first cross-sectional area. This configuration of the convergent flow channel enables the cooling system to regulate flow of cooling fluids into the manifold assembly and to prevent overheating of the trailing edge of the vane.

The turbine vane may also include a plurality of impingement channels extending from the convergent flow channel toward the leading edge and terminating in a leading edge cooling cavity aft of an inner surface of the leading edge in a leading edge cooling cavity. The impingement channels may vary in length such that a first channel located closest to the first end of the airfoil may be shorter than a second impingement channel closest to the second end of the airfoil. In at least one embodiment, each impingement channel may terminate at a substantially similar distance from the inner surface of the leading edge to maintain high impingement jet velocity and high impingement cooling effectiveness. This configuration is achieved by increasing the length of each impingement channel moving from the first end of the airfoil to the second end of the airfoil. The cross-sectional area of each impingement channel may be substantially equal or may vary. Likewise, the distance between each impingement channel may be substantially equal or may vary as well.

In at least one embodiment, one or more of the plurality of impingement channels may be positioned within the leading edge cooling cavity using one or more pin fins. The pins fins may extend from an inner surface of the suction side of the vane and attach to an impingement channel or may extend from the inner surface of the pressure side of the vane and attach to the impingement channel, or both. In at least one embodiment, each of the impingement channels is held in position using pin fins. The pin fins increase the surface area available for convection, thereby increasing the cooling capacity of the cooling system.

In at least one embodiment, the convergent flow path forms a portion of a serpentine cooling path in an aft portion of the turbine vane. The serpentine cooling path may have numerous passes, which in at least one embodiment may number three passes. The serpentine cooling path may be in communication with one or more exhaust orifices in the trailing edge of the turbine vane for exhausting cooling fluids from the vane.

In operation, a cooling fluid enters the cooling system from a shroud assembly through one or more inlets in the first end of the turbine vane. The cooling fluid enters the convergent flow channel and, a substantial portion of the cooling fluid is then bled off of the convergent flow channel through the impingement channels. The cooling fluid flows through the impingement channels and impinges against the inner surface of the leading edge. The cooling fluid then flows through the leading edge cooling cavity and is exhausted to the manifold assembly. The cooling fluids remaining in the convergent flow channel is passed through a serpentine cooling path and exhausted through one or more exhaust orifices in the trailing edge of the blade.

An advantage of this invention is that the cooling system is capable of removing sufficient heat without necessitating external film cooling.

Another advantage of this invention is that the leading edge cooling cavity may be configured as a divergent cooling cavity, which minimizes cross flow of the cooling fluids passing through impingement channels proximate to the first end of the airfoil.

Yet another advantage of this invention is that the pin fins increase the cooling capacity of the cooling system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
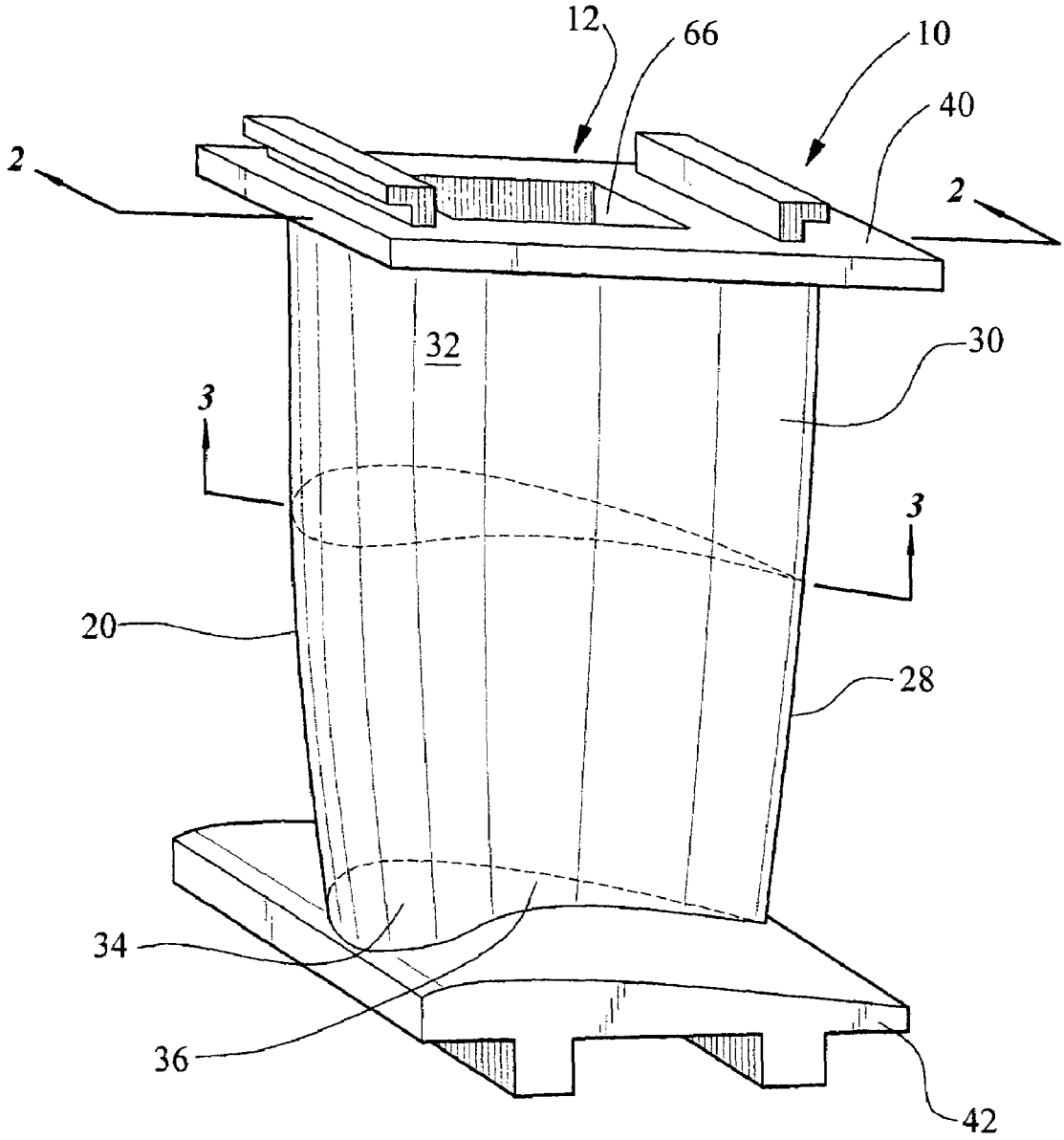
FIG. 1 is a perspective view of a turbine vane having features according to the instant invention.
Figure 2:
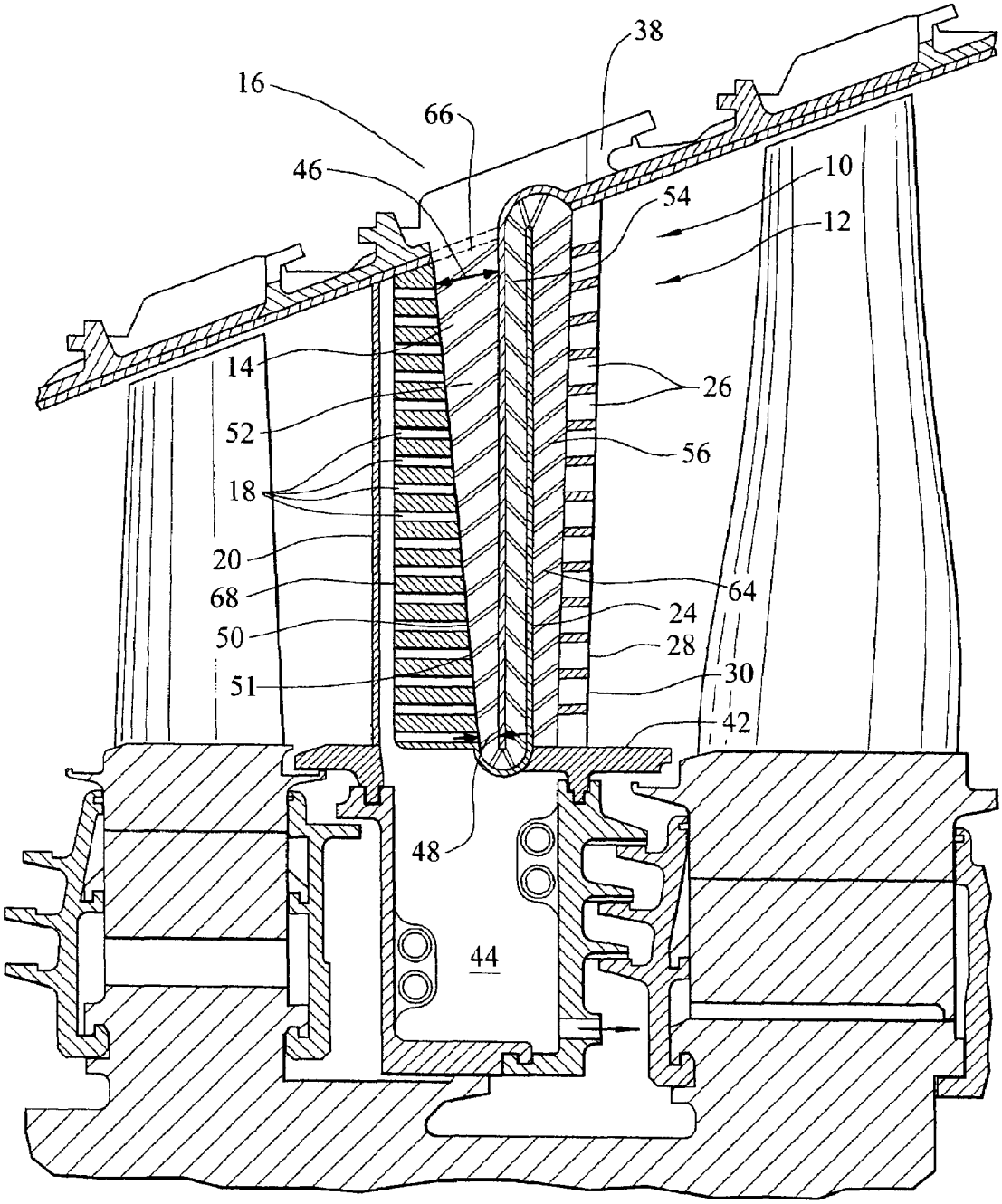
FIG. 2 is cross-sectional view of the turbine vane shown in FIG. 1 taken along line 2-2.
Figure 3:
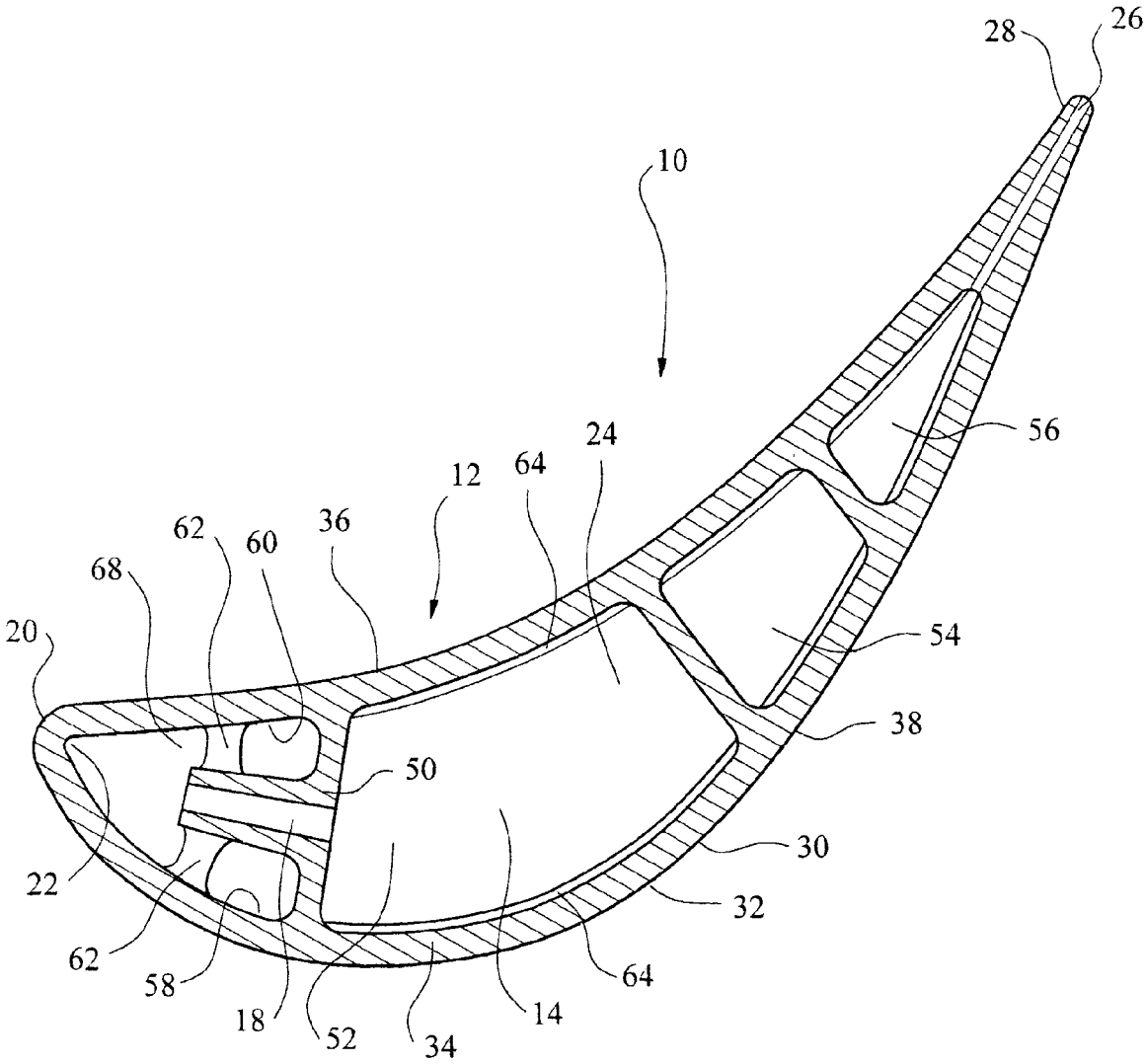
FIG. 3 is a cross-sectional view of the turbine vane shown in FIGS. 1 and 2 taken along line 3-3 in FIG. 2.

As shown in FIGS. 1-3, this invention is directed to a turbine vane 10 having a cooling system 12 in inner aspects of the turbine vane 10 for use in turbine engines. The cooling system 12 is configured such that adequate cooling occurs internally without using external film cooling from cooling fluids supplied through orifices in the housing forming the vane 10. In particular, the cooling system 12 includes at least one convergent flow channel 14 for receiving a cooling fluid from a shroud assembly 16, and may include one or more impingement channels 18 proximate to a leading edge 20 for directing cooling fluids to contact an inner surface 22 of the leading edge 20. In at least one embodiment, the convergent flow channel 14 may be a serpentine cooling path 24, which directs a cooling fluid through one or more exhaust orifices 26 in a trailing edge 28 of the turbine vane 10.

As shown in FIG. 1, the turbine vane 10 may be formed from a generally elongated airfoil 30 having an outer surface 32 adapted for use in an axial flow turbine engine. Outer surface 32 may be formed from a housing 34 having a generally concave shaped portion forming pressure side 36 and may have a generally convex shaped portion forming suction side 38. The turbine vane 10 may also include a first end 40 adapted to be coupled to the shroud assembly 16 and a second end 42 adapted to be coupled to a manifold assembly 44.

As shown in FIG. 2, the convergent flow channel 14 may have a first cross-sectional area 46 proximate to the first end 40 of the airfoil 30 that is larger than a second cross-sectional area 48 closer to the second end 42 of the airfoil 30 than the first cross-sectional area 46. In at least one embodiment, the convergent flow channel 14 may extend from the first end 40 of the airfoil 30 to a second end 42 of the airfoil 22. In other embodiments, the convergent flow channel 14 may not extend the entire length between the first and second ends 40, 42. In at least one embodiment, the convergent flow channel 14 may be a first inflow section 52 of the serpentine cooling path 24. The serpentine cooling path 24 may also include a first outflow section 54 and a second inflow section 56 forming a three-pass serpentine cooling path. The serpentine cooling path 24 is not limited to a three-pass system, but may have additional or fewer flow paths. Exhaust orifices 26 may be positioned in the trailing edge 28 and provide a pathway for cooling fluids to be exhausted from the second inflow section 56. In at least one embodiment, the serpentine cooling path 24 may include trip strips 64 for mixing cooling fluids as the cooling fluids flow through the serpentine cooling path 24 and for increasing the amount of heat removed from the turbine vane 10.

The convergent flow channel 14 may be formed from at least one rib 50 positioned between the leading edge 20 and the convergent flow channel 14. The rib 50 may be positioned in a generally nonparallel position relative to the leading edge 20, which forms a divergent leading edge cooling cavity 68. The divergent leading edge cavity 68 receives cooling fluids from the impingement channels 18. The divergent leading edge cooling cavity 68 minimizes the cross flow effect of cooling fluids flowing parallel to the inner surface 22 of the leading edge 20 and thereby, maximizes heat transfer at the inner surface 22. The rib 50 may include one or more orifices 51 to which the impingement channels 18 may be coupled. In at least one embodiment, as shown in FIG. 2, the rib 50 may include a plurality of orifices 51 to which impingement channels 18 may be coupled. One or more impingement channels 18 may extend from the rib 50 to towards an inner surface 22 of the leading edge 20. In at least one embodiment, the impingement channels 18 may terminate in the divergent leading edge cooling cavity 68 aft of the inner surface 22 of the leading edge 20. Each impingement channel 18 may terminate at a substantially equal distance from the inner surface 22 of the leading edge 20, which allows cooling fluids flowing through the impingement channels 18 to maintain a high impingement jet velocity and impingement cooling effectiveness. The impingement channels 18 may have substantially equal cross-sectional areas or may have cross-sectional areas having difference sizes. The impingement channels 18 may be spaced apart at substantially similar distances or at equal distances.

In at least one embodiment, as shown in FIG. 2, the turbine vane 10 may include a plurality of impingement channels 18 extending between the rib 50 and the leading edge 20 and positioned from the first end 40 of the airfoil 30 to the second end 42 of the airfoil 30. The impingement channels 18 regulate the flow of cooling fluids through the turbine vane 10 and prevent overflow of cooling fluids to the manifold assembly 44. By preventing overflow to the manifold assembly 44, the possibility of overheating portions of the housing 34 proximate to the trailing edge 28 is reduced. The impingement channel 18 positioned at the first end 40 may have the shortest length of the impingement channels 18 positioned between the first and second ends 40, 42. The impingement channels 18 may increase in length proceeding from the first end 40 to the second end 42. In other words, each impingement channel 18 may be longer than the impingement channel 18 immediately adjacent to the channel 18 and closer to the first end 40 of the airfoil 30. The impingement channels 18 may be positioned at a substantially equal distance from each other or may be positioned a varying distances from each other.

In at least one embodiment, the impingement channels 18 may be held in position between an inner surface 58 of the suction side 38 and an inner surface 60 of the pressure side 36 using one or more pin fins 62. One or more of the impingement channels 18 may be supported by a pin fin 62 positioned between an inner surface 60 of the pressure side 36 and the impingement channel 18, or positioned between an inner surface 58 of the suction side 38 and the impingement channel 18, or both. The pin fins 62 increase the surface area of the housing 34 and thereby increase the amount of convection surfaces.

In operation, a cooling fluid enters the cooling system 12 through an inlet 66 in the convergent flow channel 14. The inlet 66 may be sized and configured to regulate the flow of cooling fluids into the convergent flow channel 14. The cooling fluids are bled into the impingement channels 18 from the convergent flow channel 14. The cooling fluids flow through the impingement channels 18 and are exhausted into the leading edge cool cavity 68. The cooling fluids impinge against the inner surface 22 of the leading edge 20. The cooling fluids then flow through the leading edge cooling cavity 68 to the manifold assembly 44. In at least one embodiment including a divergent leading edge cooling cavity 68, the negative effects of cooling fluid cross flow is reduced to the point of being almost negligible because the cavity 68 increases in cross-sectional area as additional cooling fluid is emitted from each impingement channel 18, moving from the first end 40 to the second end 42 of the airfoil 30. Thus, cross-flow velocity is maintained at a substantially steady rate. Cooling fluids not flowing into the impingement channels 18 continue to flow through the serpentine cooling path 24 and are exhausted through the exhaust orifices 26. The amount of cooling fluids flowing through the turbine vane 10 and into the manifold assembly 44 is controlled by the number and cross-sectional areas of the impingement channels 18.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane, comprising:

a generally elongated hollow airfoil having a leading edge, a trailing edge, a pressure side, a suction side, a first end adapted to be coupled to a shroud assembly, and a second end opposite the first end adapted to be coupled to a manifold assembly;

a convergent flow channel having an inlet generally at the first end of the generally elongated hollow airfoil and extending toward the second end of the generally elongated hollow airfoil; wherein the convergent flow channel has a first cross-sectional area proximate to the first end of the generally elongated hollow airfoil that is larger than a second cross-sectional area of the convergent flow channel closer to the second end of the generally elongated hollow airfoil than a location of the first cross-sectional area;

a plurality of impingement channels extending from the convergent flow channel toward the leading edge and terminating in a leading edge cavity aft of an inner surface of the leading edge; and wherein the plurality of impingement channels vary in length such that a first channel located closest to the first end of the generally elongated hollow airfoil is shorter than a second channel closest to the second end of the generally elongated hollow airfoil.

2. The turbine vane of claim 1, wherein the plurality of impingement channels each terminate at a substantially equal distance from an inner surface of the leading edge of the generally elongated hollow airfoil.

3. The turbine vane of claim 1, wherein each impingement channel is longer than an adjacent impingement channel positioned closer to the first end of the generally elongated hollow vane.

4. The turbine vane of claim 1, wherein at least a portion of the plurality of impingement channels have different cross-sectional areas.

5. The turbine vane of claim 1, wherein each of the plurality of impingement channels have substantially equal cross-sectional areas.

6. The turbine vane of claim 1, wherein distances between adjacent impingement channels vary.

7. The turbine vane of claim 1, wherein distances between adjacent impingement channels are substantially equal.

8. The turbine vane of claim 1, further comprising a plurality of pin fins coupled to at least one of the impingement channels and positioning the impingement channel inside the generally elongated hollow airfoil.

9. The turbine vane of claim 8, wherein each of the plurality of impingement channels has at least one pin fin extending between an inner surface of the suction side of the generally elongated hollow airfoil and attaching to an impingement channel and has at least one pin fin extending between an inner surface of the pressure side of the generally elongated hollow airfoil and attaching to the impingement channel.

10. The turbine vane of claim 1, wherein the convergent flow channel further comprises a first outflow section and a second inflow section forming a serpentine cooling path comprising at least a three pass cooling path, wherein a plurality of exhaust orifices are located in the trailing edge in communication with the serpentine cooling path.

11. The turbine vane of claim 1, further comprising a plurality of trip strips in the serpentine cooling path.

12. The turbine vane of claim 1, wherein the leading edge cavity is a divergent leading edge cavity.

13. A turbine vane, comprising:

a generally elongated hollow airfoil having a leading edge, a trailing edge, a pressure side, a suction side, a first end adapted to be coupled to a shroud assembly, and a second end opposite the first end adapted to be coupled to a manifold assembly;

a serpentine cooling path formed from a convergent flow channel forming a first inflow section, a first outflow section, and a second inflow section having a plurality of exhaust orifices in the trailing edge, the convergent flow channel having an inlet generally at the first end of the generally elongated hollow airfoil and extending toward the second end of the generally elongated hollow airfoil, wherein the convergent flow channel has a first cross-sectional area proximate to the first end of the generally elongated hollow airfoil that is larger than a second cross-sectional area of the convergent flow channel closer to the second end of the generally elongated hollow airfoil than a location of the first cross-sectional area;

a plurality of impingement channels extending from the convergent flow channel toward the leading edge and terminating in a divergent leading edge cavity aft of an inner surface of the leading edge; and wherein the plurality of impingement channels vary in length such that a first impingement channel located closest to the first end of the generally elongated hollow airfoil is shorter than an impingement channel located immediately adjacent the first impingement channel, and each impingement channel is longer than an impingement channel positioned immediately adjacent and closer to the first end of the generally elongated hollow airfoil.

14. The turbine vane of claim 13, wherein the plurality of impingement channels each terminate at a substantially equal distance from an inner surface of the leading edge of the generally elongated hollow airfoil.

15. The turbine vane of claim 13, wherein at least a portion of the plurality of impingement channels have different cross-sectional areas.

16. The turbine vane of claim 13, wherein each of the plurality of impingement channels have substantially equal cross-sectional areas.

17. The turbine vane of claim 13, wherein distances between adjacent impingement channels vary.

18. The turbine vane of claim 13, further comprising a plurality of pin fins coupled to at least one of the impingement channels and positioning the impingement channel inside the generally elongated hollow airfoil.

19. The turbine vane of claim 18, wherein each of the plurality of impingement channels has at least one pin fin extending between an inner surface of the suction side and attaching to an impingement channel and has at least one pin fin extending between an inner surface of the pressure side and attaching to the impingement channel.

20. The turbine vane of claim 13, further comprising a plurality of trip strips in the serpentine cooling pathway.

* * * * *